US007594820B2

(12) United States Patent
Eshet

(10) Patent No.: US 7,594,820 B2
(45) Date of Patent: Sep. 29, 2009

(54) METHOD AND APPARATUS FOR ELECTROSTATIC DISCHARGE OF CONNECTORS

(75) Inventor: Ori Eshet, Haifa (IL)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 12/207,088

(22) Filed: Sep. 9, 2008

(65) Prior Publication Data

US 2009/0004899 A1 Jan. 1, 2009

Related U.S. Application Data

(62) Division of application No. 11/553,225, filed on Oct. 26, 2006, now Pat. No. 7,422,455.

(51) Int. Cl.
*H01R 13/53* (2006.01)

(52) U.S. Cl. ..... 439/181

(58) Field of Classification Search ..... 439/181, 439/676, 607

See application file for complete search history.

(56) References Cited

U.S. PATENT DOCUMENTS

| | | | | |
|---|---|---|---|---|
| 6,790,097 | B1 | 9/2004 | Edwards et al. | |
| 6,935,879 | B2 * | 8/2005 | Whitney et al. | 439/181 |
| 7,422,455 | B2 | 9/2008 | Eshet | |
| 2008/0102671 | A1 | 5/2008 | Eshet | |

* cited by examiner

*Primary Examiner*—Javaid Nasri
(74) *Attorney, Agent, or Firm*—Grossman, Tucker, Perreault & Pfleger, PLLC

(57) ABSTRACT

A port (such as, but not limited to, an RJ45 port) may comprise a cavity having a plurality of pins and an electrostatic discharge element coupled to a system ground. As the plug is inserted into the cavity, the electrostatic discharge element contacts the plug prior to the plug coming into electrical contact with the port pins and provides a discharge path to the system ground during a cable discharge event. Once the plug is fully inserted within the port, the electrostatic discharge element does not electrically contact the plug or the port pins and therefore has substantially no affect on the normal connection between the port and the plug.

11 Claims, 5 Drawing Sheets

METHOD AND APPARATUS FOR ELECTROSTATIC DISCHARGE OF CONNECTORS

RELATED APPLICATION

This application is a Divisional of U.S. patent application Ser. No. 11/553,225 filed Oct. 26, 2006, now U.S. Pat. No. 7,422,455, the teachings of which are incorporated herein by reference.

FIELD

The present disclosure relates generally to systems and methods for discharging electrostatic charges, and more particularly systems and methods for discharging electrostatic charges in Ethernet connectors.

BACKGROUND INFORMATION

Many computer and electronics systems include removable and/or replaceable circuit boards. Such removable circuit boards may, for example, be in the form of computer blades, cards, etc. A typical removable circuit board or add-in card may include an Ethernet card having one or more connectors, ports or jacks (such as an RJ45 connector) that act as a physical interface between the card and another device (typically a cable such as, but not limited to, twisted pair type cables). Connectors/jacks may also be found as an integral part of a motherboard (such as, but not limited to, a laptop computer motherboard or the like) as well as other boards (such as, but not limited to, fax machines and the like.

Unfortunately, electrostatic charges can build up on the cable. If this electrostatic build-up is not discharged prior to making the electrical connection with the connector on the card, the electrostatic charge can be transferred from the cable to the card possibly resulting in damage to the card or other components of the electronic system.

Accordingly, there exists a need for an improved connector that obviates or reduces the risk of electrostatic discharge. It is important to note that the present disclosure is not intended to be limited to a system or method which must satisfy one or more of any stated objects or features of the invention. It is also important to note that the present disclosure is not limited to the preferred, exemplary, or primary embodiment(s) described herein. Modifications and substitutions by one of ordinary skill in the art are considered to be within the scope of the present disclosure, which is not to be limited except by the following claims.

BRIEF DESCRIPTION OF THE DRAWINGS

Features and advantages of the claimed subject matter will be apparent from the following detailed description of embodiments consistent therewith, which description should be considered with reference to the accompanying drawings, in which:

DETAILED DESCRIPTION

Figure 1:
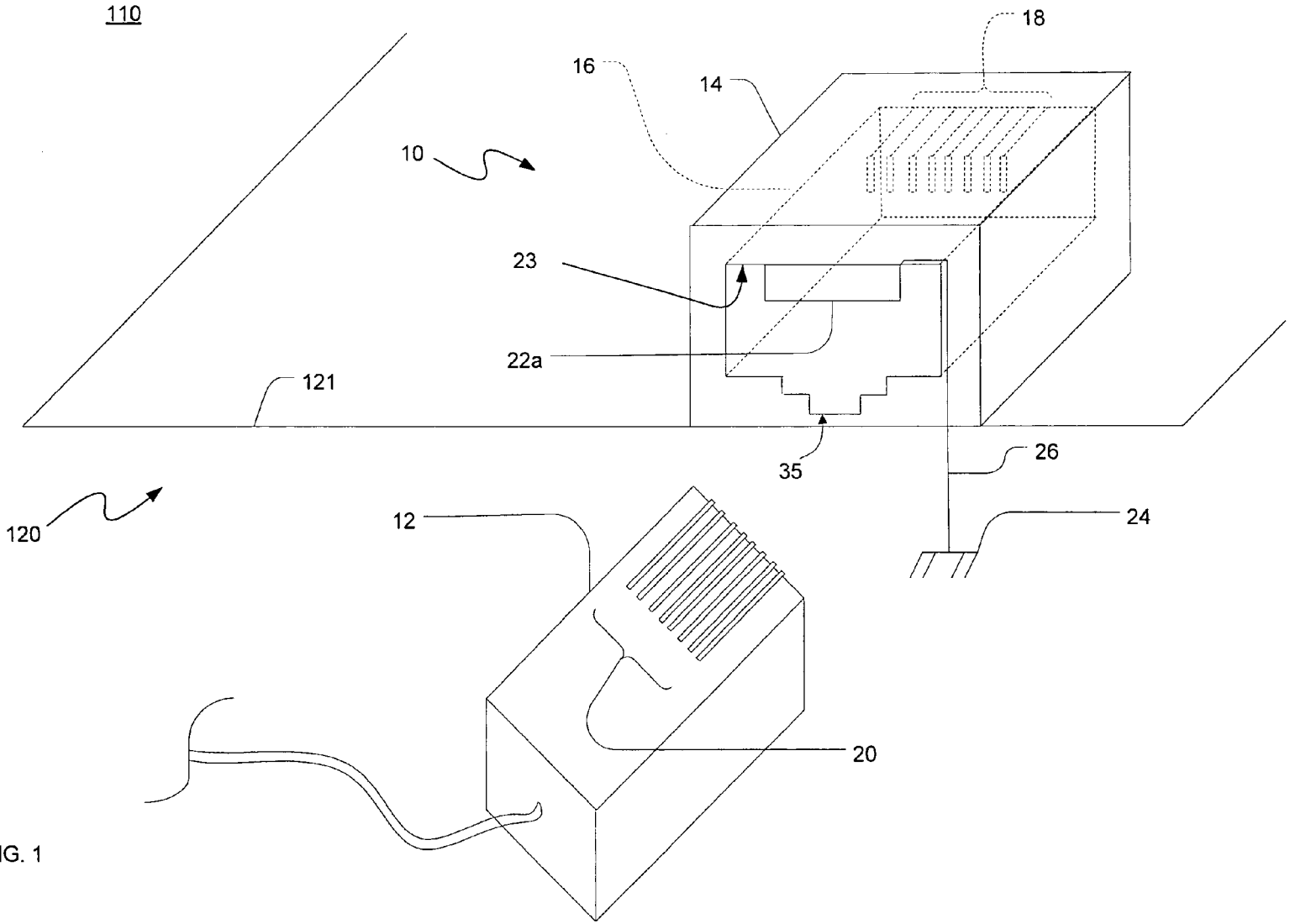
FIG. 1 is a front perspective view of an I/O interface and a plug wherein the I/O interface includes one embodiment of an electrostatic discharge element according to the present disclosure.

Consistent with the present disclosure, various embodiments of input/output (I/O) interfaces 110 which may be configured to provide a cable discharge event (CDE) and substantially discharge an electrostatic charge built-up on a cable plug 12 or the like are shown in FIGS. 1-4. The input/output (I/O) interfaces 110 according to the present disclosure may therefore reduce the possibility of the electrostatic charge on the plug 12 damaging either the circuit board assemblies 120 and/or another component connected to the circuit board assemblies 120.

The I/O interfaces 110 may comprise a body or housing 14 of a dielectric material (such as, but not limited to, various plastics or the like) that defines a cavity 16 which may be mechanically and/or electrically connected to a circuit board 121 using any device known to those skilled in the art. The cavity 16 may be sized and shaped to accept the cable plug 12 and form an electrical connection between one or more pins 18 of the I/O interfaces 110 (which are configured to be electrically coupled to the circuit board 121) and the pins 20 of the plug 12. The pins 18 may be disposed proximate a rear portion of the cavity 16 generally opposite from a notched region 35 and may be biased towards a base or center of the cavity 16. The notched region 35 ensures that the plug 12 can only be inserted in a specific orientation with respect to the I/O interfaces 110.

For sake of clarity, the present disclosure will be described wherein the I/O interface 110 comprises an RJ45 jack or port 10 configured to connect with a corresponding RJ45 plug 12. For example, the RJ45 cable connection 110 may be defined by IEEE 802.3 (Ethernet). However, this is not a limitation of the present disclosure and the I/O interface 110 may also comprise other connections such as, but not limited to, RJ11 connections.

The port 10 may also comprise one or more electrostatic discharge (ESD) elements 22 which are coupled to a ground 24 and may be configured to prevent or reduce the possibility of electrostatic charge on the plug 12 from damaging the circuit board 120. As the plug 12 is inserted into the cavity 16, the ESD elements 22 may contact the pins 20 of the plug 12 to provide a discharge path to a ground 24, thereby discharging any electrostatic charge that has built-up on the plug 12. The term "ground" as used herein refers to any potential (including a zero potential or true ground) that may be used as a reference potential in a given system. According to one embodiment, the ESD elements 22 may be positioned within the cavity 16 (for example, proximate the opening of the cavity 16) to allow the ESD elements 22 to contact the pins 20 of the plug 12 (and therefore discharges any electrostatic charge on the plug 12) prior to the pins 20 of the plug 12 coming into electrical contact with the pins 18 of the port 10.

The ESD elements 22 may be flexible such that the ESD elements 22 may bend or otherwise move out of the way as the plug 12 is inserted into the cavity 16 and may be biased towards the center of the cavity 16. According to one embodiment, the ESD elements 22 may be positioned on substantially the same face of the cavity 16 as the pins 18. Alternatively, the ESD elements 22 may be positioned on the opposite face of the cavity 16. In either case, the ESD elements 22 may be positioned with respect to the cavity 16 such that the ESD elements 22 contact the pins 20 of the plug 12 sufficiently far enough away from the pins 18 of the port 10 to substantially eliminate the possibility of the electrostatic charge on the plug 12 arcing to the pins 18 of the port 10. The size and position of the ESD elements 22 may be selected such the ESD elements 22 may easily contact the pins 20 of the plug 12 as the plug 12 is initially inserted into the cavity 16, yet when the plug 12 is fully inserted into the cavity 16, the ESD elements 22 bend or otherwise move out of the way and substantially do not contact either the pins 18, 20 of the port 10 or the plug 12 and therefore do not have any affect on the normal connection between the port 10 and the plug 12.

Figure 2:
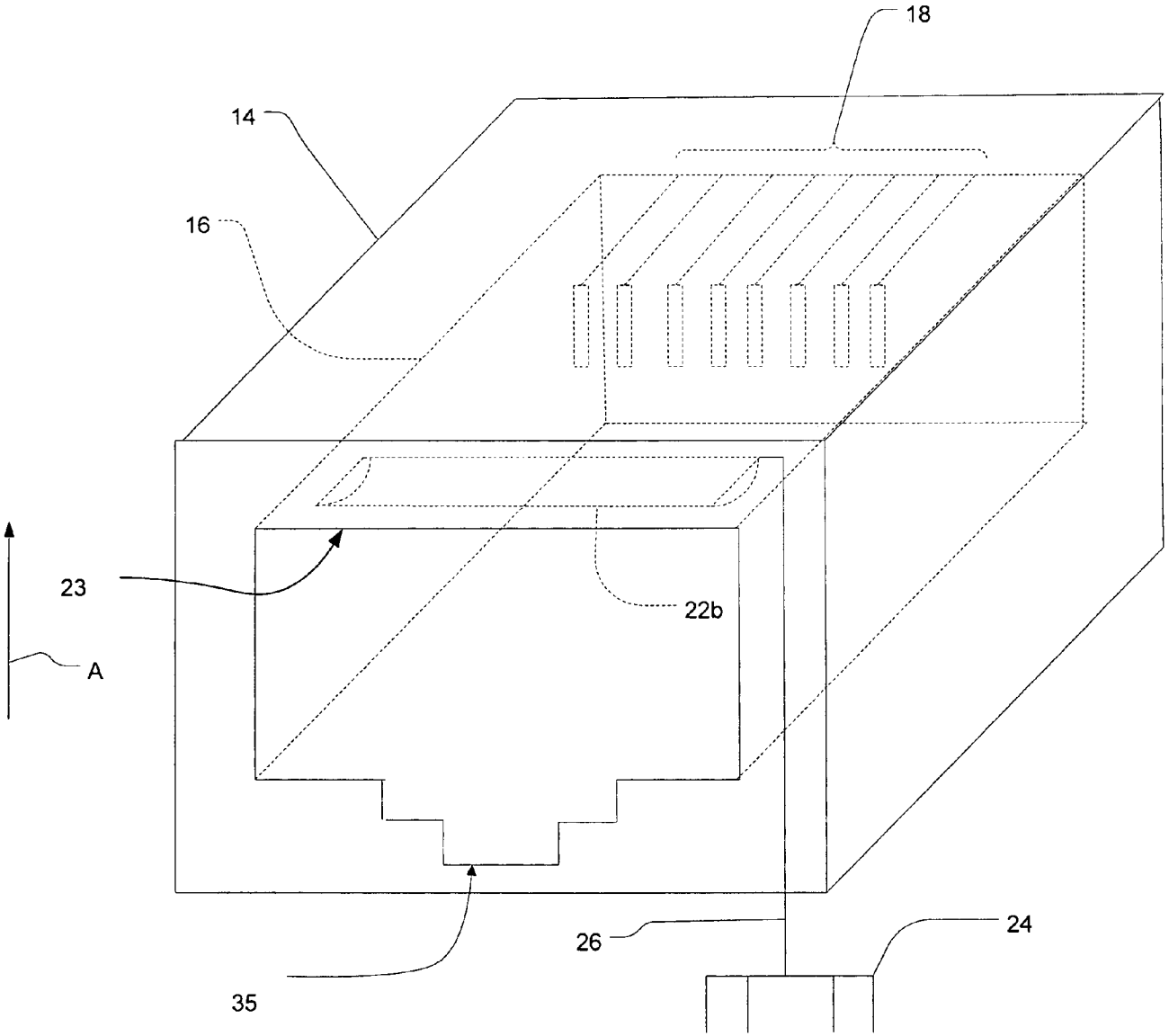
FIG. 2 is a front perspective view of an I/O interface having another embodiment of an electrostatic discharge element according to the present disclosure.

According to one embodiment, the ESD elements 22, FIGS. 1 and 2, may include a single ESD element 22 made from a conductive material (such as, but not limited to, conductive metals, alloys, composites, or any material that has been doped to be conductive) disposed proximate the opening of the cavity 16 which is electrically coupled to the ground 24, for example, by way of a conductive path 26. The ESD element 22 may include a flexible plate or the like which is sized to electrically contact all of the pins 20 of the plug 12 as the plug 12 is inserted into the cavity 16. According to one embodiment, the flexible plate 22*a*, FIG. 1, may extend substantially downwards from a first surface 23 of the cavity 16 towards the center. For example, the flexible plate 22*a* may include a first position in which the flexible plate 2*a*2 is disposed at an angle of approximately 90 degrees from the first surface 23 prior to the plug 12 being inserted into the cavity 16 and may bend or otherwise move towards a second position in which the flexible plate 22*a* is substantially parallel with the first surface 23 once the plug 12 is fully inserted into the cavity 16.

Of course, the flexible plate 22 may also be disposed at other angles greater or less than 90 degrees from the first surface 23. For example, the single ESD element 22*b*, FIG. 2, may be disposed substantially parallel with the first surface 23 of the cavity 16 and biased towards the center (for example by one or more springs or the like, not shown) while in the first position. As the plug 12 is inserted into the cavity 16, the flexible plate 22*b* electrically contacts the pins 20 of the plug 12. Once the plug 12 is fully inserted in the cavity 16, the flexible plate 22*b* may be disposed in the second position and may pushed generally in the direction of arrow A into the housing 14 of the port 10.

Consistent with other embodiments of the present disclosure, the ESD elements 22, FIGS. 3 and 4, may comprise a plurality of conductive pins, wires, or brushes 25 (hereinafter collectively referred to as "conductive brushes"). The number of the conductive brushes 25 may correspond to the number of pins 20 on the plug 12 and may be positioned/spaced such that each conductive brush 25 contacts a single pin 20. Alternatively, the plurality of conductive brushes 25 may be more numerous than the number of pins 20 and may be formed in groups or spread substantially evenly across a surface of the cavity 16.

Figure 3:
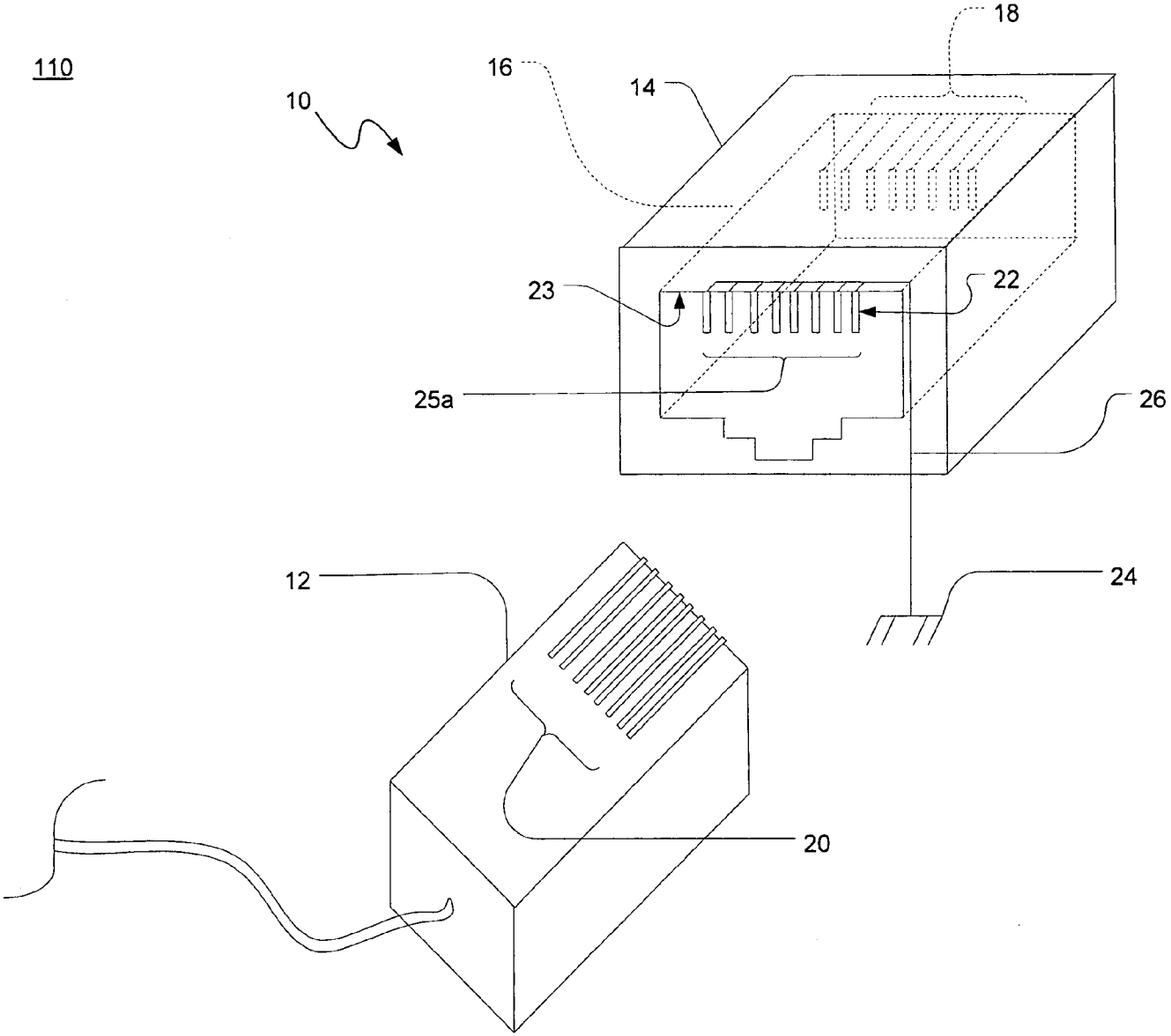
FIG. 3 is a front perspective view of an I/O interface and a plug wherein the I/O interface includes a further embodiment of an electrostatic discharge element according to the present disclosure.
Figure 4:
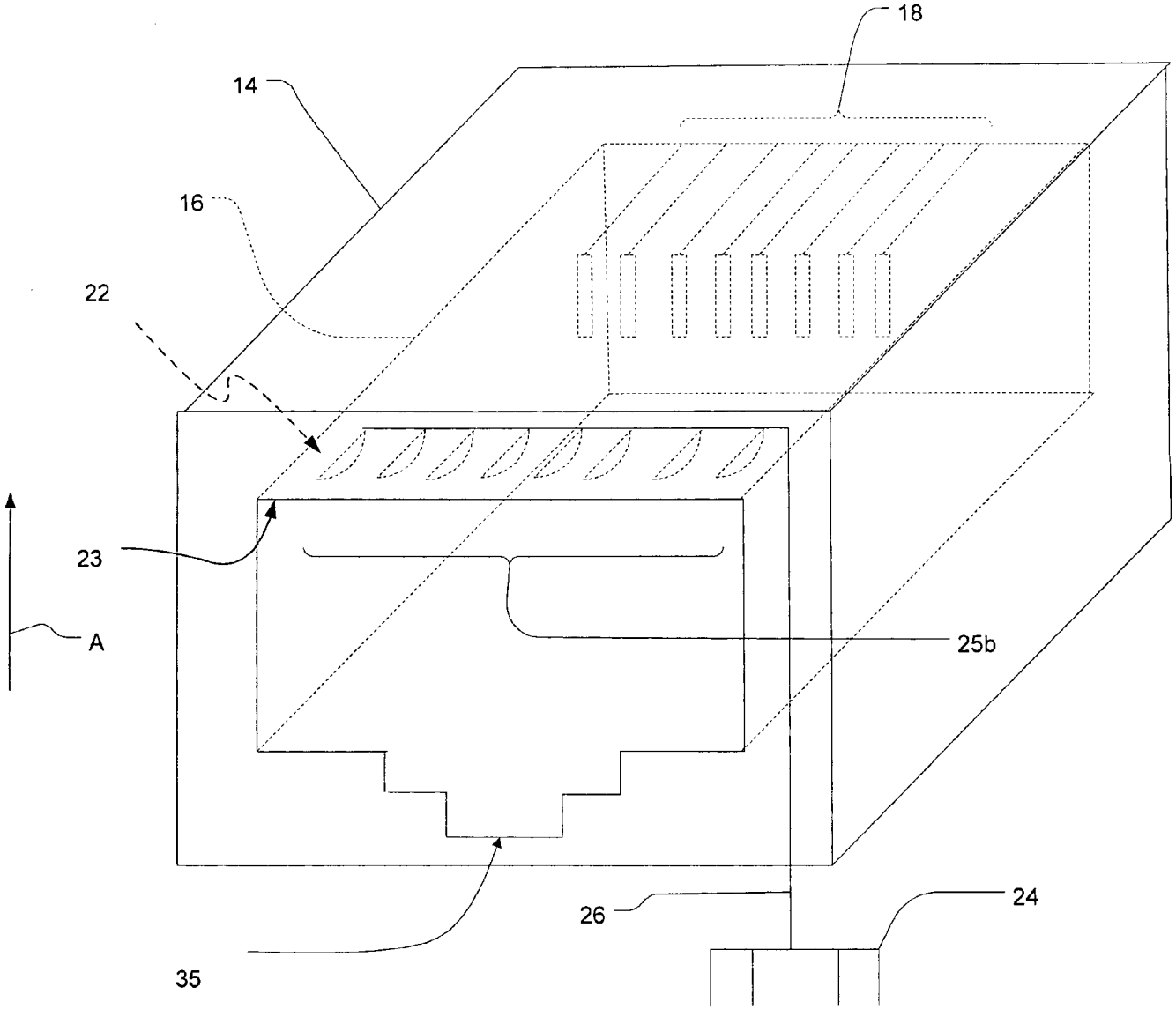
FIG. 4 is a front perspective view of an I/O interface having yet another embodiment of an electrostatic discharge element according to the present disclosure.

The conductive brushes 25*a*, FIG. 3, may extend substantially downwards from a first surface 23 of the cavity 16 towards the center. For example, the conductive brushes 25*a* may include a first position in which the conductive brushes 25*a* may be originally disposed at an angle of approximately 90 degrees from the first surface 23 prior to the plug 12 being inserted into the cavity 16 and may bend or otherwise move towards a second position in which conductive brushes 25*a* are substantially parallel with the first surface 23 once the plug 12 is fully inserted into the cavity 16.

Of course, the conductive brushes 25 may also be disposed at other angles greater or less than 90 degrees from the first surface 23. For example, the conductive brushes 25*b*, FIG. 4, may be disposed substantially parallel with the first surface 23 of the cavity 16 and biased towards the center (for example by one or more springs or the like, not shown) while in a first position prior to the plug 12 being inserted into the cavity 16. As the plug 12 is inserted into the cavity 16, the conductive brushes 25*b* electrically contact the pins 20 of the plug 12 and may pushed generally in the direction of arrow A towards a second position wherein the conductive brushes 25*b* at least partially disposed within the housing 14 of the port 10.

Figure 5:
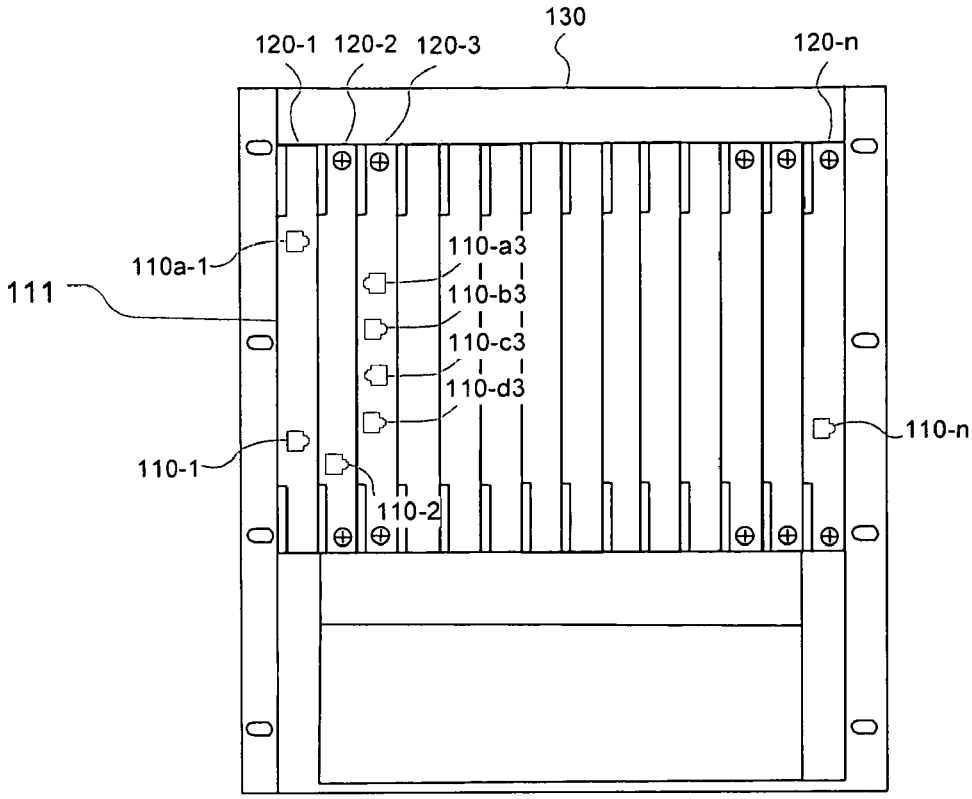
FIG. 5 is a front view of a computer system chassis including circuit boards with input/output (I/O) interfaces, consistent with one embodiment of the present disclosure.
Figure 6:
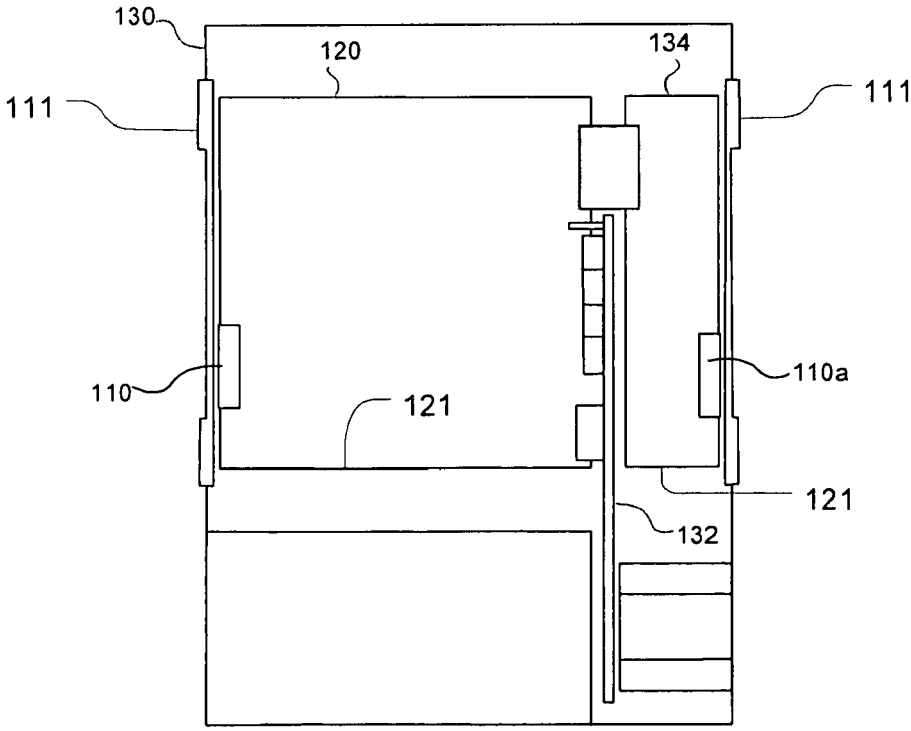
FIG. 6 is a side view of the computer system chassis shown in FIG. 5.

Referring specifically to FIGS. 5 and 6, one or more input/output (I/O) interfaces 110-1 to 110-*n* may be electrically coupled to one or more blades or circuit board assemblies 120-1 to 120-*n* in a computer system shelf or chassis 130 for transmitting and/or receiving a signal between a circuit board assembly 120 and another device. The circuit board assemblies 120 may include a faceplate 111 extending along at least a portion of one edge of a circuit board 121 to which the I/O interfaces 110 may be secured. The faceplate 111 may include a latching system capable of releasably coupling the circuit board assembly 120 to the chassis 130 and/or to a feature of the chassis 130 and/or a component disposed at least partially within the chassis 130. As shown in FIG. 6, the circuit board assemblies 120 may be coupled to a common backplane 132 within the chassis 130 (only one circuit board assembly 120 is shown in the side view of FIG. 2). The chassis 130 may also include one or more rear circuit board assemblies 134 (e.g., rear transition modules) located on a second (or rear) side of the backplane 132 opposite one or more corresponding front circuit board assemblies 120. The rear circuit board assemblies 134 may also include one or more I/O interfaces 110*a*.

In some embodiments, the circuit board assemblies 120 may include circuit boards 121 that provide application functionality (e.g., single blade computers, storage blades, network processing (such as, but not limited to, Ethernet cards) and I/O blades) and switch boards that provide switching interconnectivity between the node boards (e.g., fabric switches). The computer system chassis 130 may be an advanced telecommunications computing architecture (Advanced TCA or ATCA) chassis complying with or compatible with, at least in part, PCI Industrial Computer Manufacturers Group (PICMG), Advanced Telecommunications Computing Architecture (ATCA) Base Specification, PICMG 3.0 Rev. 2.0, published Mar. 18, 2005, and/or later versions of the specification ("the ATCA specification"). According to such an embodiment, the circuit board assemblies 120 may be ATCA blades complying with or compatible with, at least in part, the ATCA Specification.

Various other embodiments consistent with the present disclosure may include a chassis 130 and/or circuit board assemblies 120 complying with and/or compatible with technical specifications other than and/or in addition to the ATCA Specification. A circuit board assembly 120 may also be used, for example, in other types of bladed architectures including, but not limited to, VME, CompactPCI (CPCI), and IBM BladeCenter®. A circuit board assembly 120 may also be used on other computer or electronic devices that use multiple types of I/O interfaces including, but not limited to, notebook computers, desktop computers, home entertainment products, mobile products (e.g., PDAs, cell phones, MP3 players, DVD/CD players, etc.) and automotive entertainment and communication products. The scope of the present disclosure should not, therefore, be construed as being limited to any particular computer system, device, or form factor.

Accordingly, the present disclosure provides a method and apparatus for providing a cable discharge event (CDE) prior to the cable plug coming into electrical contact with the pins of the port. The port includes one or more electrostatic discharge (ESD) elements coupled to ground. As the cable plug is inserted into the port, the ESD elements electrically contact the cable plug (specifically the plug pins) thereby providing a discharge path to the system's ground. As the plug is fully inserted into the port, the ESD elements may move out of the way such that they are not in electrical contact with either the pins of the plug or the port and therefore have substantially no affect on the normal connection/operation of the plug and port. The circuit board (and other circuits coupled thereto) may thus be protected from potentially destructive CDE.

As mentioned above, the present disclosure is not intended to be limited to a system or method which must satisfy one or more of any stated or implied object or feature of the invention and should not be limited to the preferred, exemplary, or primary embodiment(s) described herein. The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the claims when interpreted in accordance with breadth to which they are fairly, legally and equitably entitled.

The invention claimed is:

1. A system comprising:

a frame comprising at least one chassis; and a circuit board assembly configured to be coupled to said chassis, said circuit board assembly comprising:

a circuit board; and at least one port comprising:

a cavity configured to accept a plug;

a plurality of pins disposed within said cavity; and at least one electrostatic discharge element secured to said port between said plurality of pins and an opening of said cavity, wherein said electrostatic discharge element is configured to be coupled to a system ground and to electrically contact said plug prior to said plug electrically contacting said plurality of pins of said port, wherein said electrostatic discharge element is disposed substantially perpendicularly from an interior surface of said cavity while in a first position and is disposed substantially parallel to said interior surface while in a second position.

2. The system of claim 1, wherein said electrostatic discharge element comprises a flexible, conductive material.

3. The system of claim 2, wherein said electrostatic discharge element is secured to said interior surface of said cavity and is biased towards a center of said cavity.

4. The system of claim 1, wherein said electrostatic discharge element further comprises said first position prior to said plug being inserted into said cavity and said second position after said plug is fully inserted into said cavity, wherein said electrostatic discharge element is not electrically connected to either said plug or said pins of said port while in said second position.

5. The system of claim 4, wherein said at least one electrostatic discharge element is configured to contact at least one pin of said plug prior to said plug electrically contacting said plurality of pins of said port.

6. The system of claim 5, wherein said at least one electrostatic discharge element comprises a single electrostatic discharge element.

7. The system of claim 6, wherein said single electrostatic discharge element is configured to contact a plurality of pins of said plug.

8. The system of claim 5, wherein said at least one electrostatic discharge element comprises a plurality of electrostatic discharge elements, each of said plurality of conductive elements being configured to contact at least one of a plurality of pins of said plug prior to said plug electrically contacting said plurality of pins of said port.

9. The system of claim 8, wherein a number of said electrostatic discharge elements corresponds to a number of pins of said plug.

10. The system of claim 1, wherein said port further comprises an RJ45 port.

11. The system of claim 1, wherein said port further comprises an RJ11 port.

* * * * *